United States Patent [19]

Lessard et al.

[11] Patent Number: 4,708,165

[45] Date of Patent: Nov. 24, 1987

[54] HIGH PRESSURE STEPPED CLEARANCE SEAL VALVE IN A CRYOGENIC REFRIGERATION SYSTEM

[75] Inventors: Philip A. Lessard, Acton; Marshall J. Smith, Danvers, both of Mass.

[73] Assignee: Helix Technology Corporation, Waltham, Mass.

[21] Appl. No.: 857,722

[22] Filed: Apr. 29, 1986

[51] Int. Cl.[4] ..... F25B 9/00; F16K 31/12

[52] U.S. Cl. ..... 137/509; 62/6; 251/324

[58] Field of Search ..... 62/6, 513; 60/520; 137/509, 596.18, 596.2, 509, 494; 251/324; 277/236

[56] References Cited

U.S. PATENT DOCUMENTS 4,466,251 8/1984 Lessard et al. .

4,574,591 3/1986 Bertsch ..... 62/6

*Primary Examiner*—Henry A. Bennet

*Attorney, Agent, or Firm*—Hamilton, Brook, Smith & Reynolds

[57] ABSTRACT

In an expansion engine used in cryogenic refrigeration, a stepped inlet valve 10 and a stepped exhaust valve 11 are fluid activated to control high pressure gas such as helium into and out of the engine. Clearance seals in the stepped valve are achieved by sizing a small diameter of a stepped piston to a small bore and by sizing a sleeve 16 to a larger diameter of the stepped piston. The sleeve 16 fits loosely within a large bore, and is fixed into position by placing a wire of soft metal 9 between the sleeve and the wall of the cylinder.

13 Claims, 2 Drawing Figures

HIGH PRESSURE STEPPED CLEARANCE SEAL VALVE IN A CRYOGENIC REFRIGERATION SYSTEM

GOVERNMENT SUPPORT

The Government has rights in this invention pursuant to contract F33615-81-C-3407 awarded by the Department of the Air Force.

TECHNICAL FIELD

This invention relates to high pressure cryogenic refrigeration systems. Specifically, this invention relates to stepped clearance seal valves used as control valves positioned within the cold regions of a refrigerator.

BACKGROUND

A typical expansion engine used in cryogenic refrigeration is shown in U.S. Pat. No. 4,466,251 to Chellis and Lessard. In such refrigerators, a piston is reciprocated within a cylinder. One end of this cylinder has a cold end and is placed within a cold insulated environment. Cold, high pressure gas such as helium is introduced into the cold end of the cylinder by a first valve. With upward movement of the piston, that cold gas is further cooled by expansion, and with downward movement of the piston the gas is then exhausted through a second valve. From this second value, exhausted gas is returned to ambient temperature through a heat exchanger located in the cold insulated environment. The gas passes through the heat exchanger in a counter flow heat exchange relationship with the incoming high pressure gas and, thus, cools that gas. With such an arrangement, the high pressure and the exhaust valves are positioned in the cold environment.

In order to activate both the inlet and the exhaust valves, a fluid activated control valve is positioned within the cold region of the refrigerator. As control fluid flows to the valve that fluid is cooled by a thermal regenerator. When the control fluid is exhausted, heat is restored to the fluid as it passes through the regenerator. Therefore, heat is not transferred to the high pressure or exhaust valves by the control fluid.

Currently, the activated control valve is a stepped cylinder/piston combination with very small radial clearances (e.g., 0.0001 inch). Presently, in manufacturing this step combination, the cylinder must be made of two pieces with a lapped through-hole in each. The pieces are then joined with a pliable vacuum tight seal at the parting line whereby a step shaped, concentric cylinder is formed. The problem with this assembly is that under high pressures (approximately 300 PSI) and low temperatures (approximately 4 K) this seal becomes difficult to make reliably. Other attempts such as aligning two bores by a milling machine so that the small radial gap between the piston and the cylinder is maintained proved to be too impractical in manufacturing processes.

An improvement is, therefore, needed for a more reliable means of manufacturing a stepped cylinder/piston combination with very small radial clearances.

DISCLOSURE OF THE INVENTION

A high pressure, cryogenic stepped clearance seal valve comprising this invention includes a stepped cylinder having a small bore and a large bore. A stepped piston is slidably mounted within the cylinder. The piston has a small diameter which forms a small radial clearance within the small bore and a larger diameter which loosely fits within the larger bore. A floating sleeve is then fitted to the larger diameter of the piston within the cylinder whereby a small radial clearance is obtained. To fix the sleeve in place within the large bore and provide a seal, a soft wire is fitted between the sleeve, and the wall of the cylinder.

Preferably, a second wire is fitted to the end of the sleeve opposite to the first wire between the sleeve and the large bore.

Further, it is preferred that the radial clearances form a 0.0001 inch radial clearance, and that the wire is indium or dead soft aluminum.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figures 1, 2:
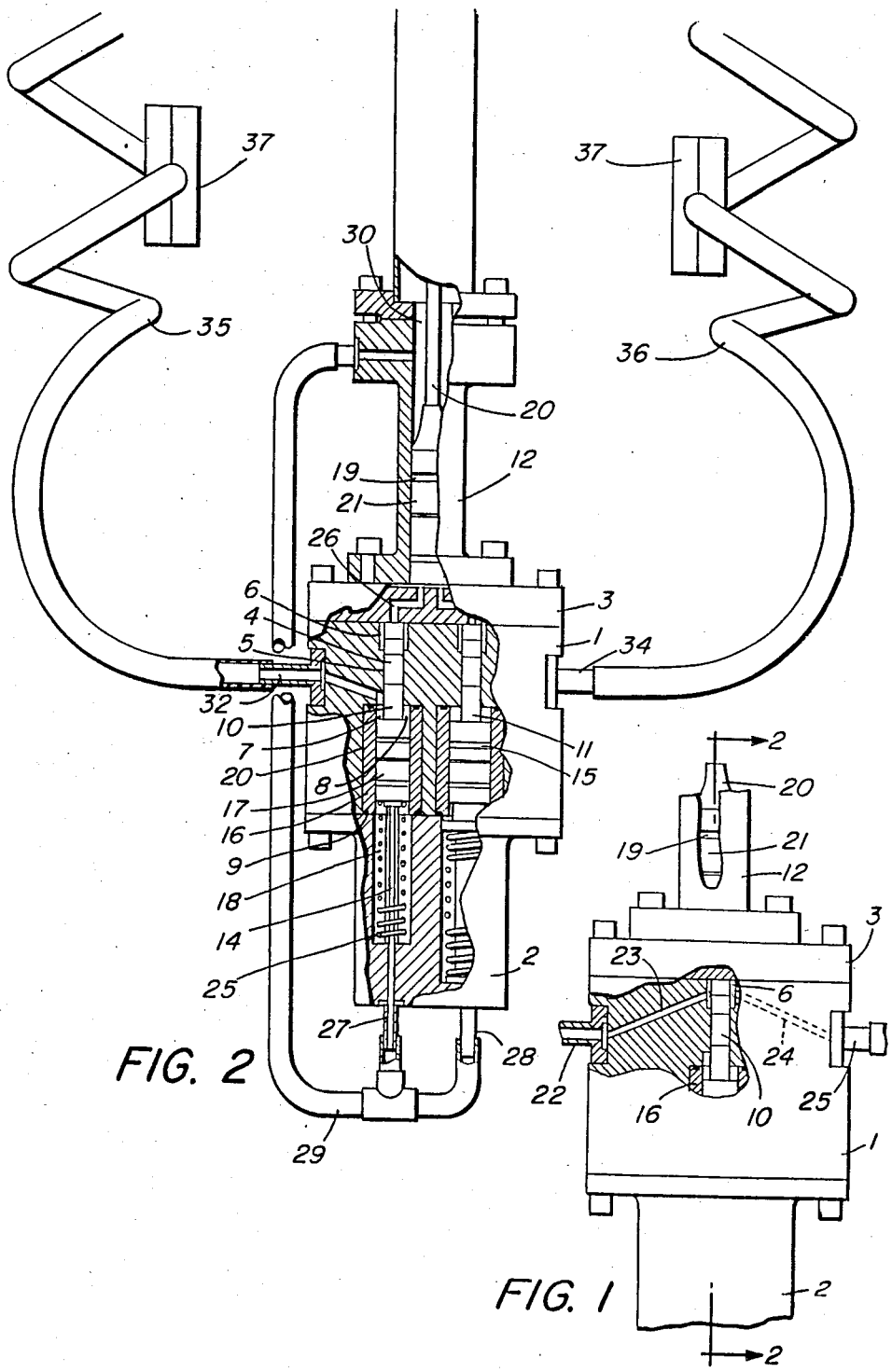
FIG. 1 is a view of the expansion engine showing the inlet and exhaust means used to introduce high pressure gas to the cold end of the expansion engine.
FIG. 2 is a view of an expansion engine of FIG. 1 rotated 90° about axis 2—2 to show stepped valves at its cold end which are designed in accordance with principles of this invention.

In FIG. 1, an expansion engine assembly showing the inlet and exhaust means is shown. An expansion engine cylinder 12 extends to a manifold 3. A piston 21 within that cylinder is driven continuously in a reciprocating mcvement by a piston rod 20. The piston is fitted within the cylinder such that a clearance seal along the piston is formed. Preferably, the diametrical clearance is 0.0001 inches. Annular grooves 19 are formed in the piston to minimize pressure differences which might cause the piston to bind within the cylinder.

Joined to the manifold 3 is a valve body 1. A tube 22 connected to the body introduces cold, high pressure, process gas such as helium into this expansion engine. The cold, high pressure, process gas from tube 22 is valved into the lower, cold end of the expansion engine by way of a stepped inlet valve 10 at the cold end. The inlet valve 10 is fluid activated to open as the piston 21 begins moving upward from its lowermost end. The process gas then passes into the cold end of the cylinder through a bore 23 in the body 1. With further upward movement of the piston, the inlet valve 10 closes before full stroke. After the inlet valve closes, high pressure gas trapped in the cylinder is further cooled by expansion. As the piston is returned in a downward stroke, a stepped exhaust valve 11, which is also fluid activated, opens to exhaust the cold, low pressure, process gas through a bore 24 and a tube 25.

In accordance with this invention, it is preferred that the inlet valve 10 and the exhaust valve 11 are fluid activated by the same fluid as the process fluid to prevent contamination. Fluid is introduced into and exhausted from these valves through respective tubes 32 and 34 shown in FIG. 2. The activating gas is controlled by solenoid spool valve positioned at ambient (not shown).

In FIG. 2, the stepped inlet valve 10 is shown in its closed position with the small diameter of the piston 4 resting against the manifold 3. The piston is held against the manifold 3 by a compressed spring 25 which is sufficiently strong to overcome the downward force presented by the high pressure process gas in the volume 26. The spring 25 is housed and biased against a spring cover 2 which is attached to the body 1. A long spring guide 14 is located within the spring. When high pressure gas is introduced into a volume 7 from tube 32, it presses downward on the surface 8 of the valve against the compressed spring 25 to pull the inlet valve away from the manifold 3. With the inlet valve in its open position the cold, high pressure, process gas is introduced into the expansion engine. The exhaust valve operates in a similar fashion. The respective control valves 10 and 11 are vented through tubes 27 and 28 to tube 29 which feeds into the space 30 between piston rod 22 and cylinder 12. In that way, the cold vented gas can be used to minimize heat flux downward through the expansion engine cylinder 12.

To maximize the temperature gradient along the length of the tubes 32 and 34 and, thus, minimize heat flow to the cold valves by the actuating gas, the tubes 32 and 34 are filled with thermally regenerative material such as nickel or lead beads or copper screen. As the high pressure actuating gas passes downward through those tubes, heat from the gas is stored in the regenerator. As the gas is exhausted back through the regenerators, the heat is returned to the gas to cool down the regenerative material in preparation for the next cycle. To increase the length of the regenerators for providing a maximum temperature gradient, the regenerator tubes are coiled at 35 and 36. A heat station 37 may also be placed on these coils.

A closer examination of FIG. 2, shows the inlet valve 10 and the exhaust valve 11 to be a stepped cylinder/-pistons combination with small radial clearances. Annular grooves 15 are formed in the pistons to minimize pressure differences which might cause binding of the piston. As shown, a small diameter of the piston 4 is closely fitted to a small bore of the cylinder wall 5 to form a clearance seal between the process gas volume 6 and the actuating gas volume 7. Additionally, a floating sleeve 16 and a large diameter of the piston 17 provide a clearance seal between a volume 7 and a vented volume 18. Thus, this construction avoids splitting the valve body into separate pieces in order to achieve alignment of the small bore and the larger bore. This construction also avoids a high pressured vacuum seal needed between these pieces.

Achieving the clearance seal between the process gas volume 6 and the high pressure gas volume 7 is accomplished by sizing the small bore of the cylinder relative to the small diameter of the piston. The clearance seal between the larger diameter of the piston and the sleeve is accomplished by sizing the inner radius of the sleeve with the larger diameter of the piston. The precise sizing of the outside diameter of the sleeve is less critical. It can fit loosely within the larger bore. The relative position of the floating sleeve is maintained by placing a wire 9 of soft metal such as indium or dead soft aluminum in the large bore of the cylinder 20 between the sleeve, the cylinder wall, and the spring cover. Preferably, the piston is reciprocated within the sleeve before firmly securing the spring cover to the valve body to create the radial clearance. With this construction, a precise alignment necessary with small radial clearances which are preferably 0.0001 inches is achieved.

A second wire may also be placed on step portion of the cylinder wall between the small bore, the larger bore and the sleeve. Although this wire is not used for the pupose of creating a high pressure seal it does provide a seal between the sleeve and the cylinder wall. The additional advantage for using indium or dead soft aluminum is that it does not become brittle under low temperatures and high pressures and, thus, loose its ability to allow valve alignment.

While the invention has been particularly shown and described with reference to preferred embodiments thereof, it will be understood by those skilled in the art that various changes in form and details may be made without departing from the spirit and scope of the invention as defined in the appended claims.

We claim:

1. A high pressure cryogenic refrigerator stepped clearance seal valve, comprising:

a. a valve body;

b. a stepped cylinder formed in the valve body by a small bore and a large bore;

c. a stepped piston having a small diameter portion which closely fits within the small bore of the cylinder and a large diameter portion which loosely fits within the large bore of the cylinder;

d. a floating sleeve which is closely fitted to the large diameter of the piston and loosely positioned within the large bore of the cylinder;

e. a wire made from soft metal fitted within the large bore of the cylinder to form a seal between the sleeve and the wall of the cylinder and to portion the sleeve within the cylinder such that it is aligned with that large diameter portion of the piston concentrically.

2. A high pressure cryogenic, stepped clearance seal valve as claimed in claim 1, wherein the radial clearance of the piston between the sleeve and the smaller bore of the cylinder is 0.0001 inches.

3. A high pressure cryogenic, stepped clearance seal valve as claimed in claim 1, wherein the wire is made of indium.

4. A high pressure cryogenic, stepped clearance seal valve as claimed in claim 1, wherein the wire is made of dead soft aluminum.

5. A high pressure cryogenic, stepped clearance seal valve as claimed in claim 1, further comprising a second wire fitted on the step of the cylinder wall between the small bore, the large bore, and the sleeve.

6. A concentric cylinder alignment mechanism for a high pressure, stepped, clearance seal valve comprising:

a. stepped cylinder comprising a smalll bore and a large bore formed in a one piece valve body;

b. a stepped piston comprising a small diameter disposed within the small bore and having a small radial clearance with the cylinder and a large diameter portion loosely disposed within the large bore;

c. a floating sleeve closely fitted over the large diameter portion of the piston such that a smaller radial clearance is created between the sleeve and the piston; and d. a wire made of soft metal disposed within the large bore between the sleeve, and the wall of the cylinder such that the position of the sleeve is fixed within the cylinder to form a seal.

7. A concentric cylinder alignment mechanism for a high pressure stepped, clearance seal valve used in cryogenic refrigeration as claimed in claim 6, wherein the wire is made of indium.

8. A concentric cylinder alignment mechanism for a high pressure stepped, clearance seal valve used in cryogenic refrigeration as claimed in claim 6, wherein the wire is made of dead soft aluminum.

9. A concentric cylinder alignment mechanism for a high pressure stepped, clearance seal valve used in cryogenic refrigeration as claimed in claim 6, wherein the small radial clearance is 0.0001 inches.

10. A concentric cylinder alignment mechanism for a high pressure stepped, clearance seal valve used in cryogenic refrigeration as claimed in claim 6, further comprising a second wire fitted within the large bore between the sleeve and the wall of the cylinder such that each wire is located at opposite ends of the large bore.

11. A method of aligning a high pressure, stepped, clearance seal valve, comprising of the steps:

a. forming a stepped piston having a small diameter portion and a large diameter portion;

b. boring a small hole within a valve body such that there is a small radial clearance between the small diameter portion of the piston and the small hole when the small diameter portion of the piston is inserted into the small hole;

c. boring a large hole over the small hole within the valve body such that the large diameter of the piston portion can be loosely fitted into it;

d. fitting a sleeve over the large piston diameter portion within the cylinder such that a small radial clearance is formed between the large piston diameter and the sleeve; and e. placing a wire within the large bore of the cylinder between the sleeve and the wall of the cylinder such that the position of the sleeve is fixed.

12. A method aligning a high pressurized, stepped, clearance seal valve as claimed in claim 11, wherein said step of placing a wire within the large bore of the cylinder is carried out with a dead soft aluminum wire.

13. A method aligning a high pressurized, stepped, clearance seal valve as claimed in claim 11, wherein said step of placing a wire within the large bore of the cylinder is carried out with a indium wire.

* * * * *